US012514328B2

(12) United States Patent
Sakamoto et al.

(10) Patent No.: US 12,514,328 B2
(45) Date of Patent: Jan. 6, 2026

(54) SHOE

(71) Applicant: ASICS CORPORATION, Hyogo (JP)

(72) Inventors: Masanori Sakamoto, Hyogo (JP); Ayu Bessho, Hyogo (JP); Seigo Nakaya, Hyogo (JP); Kenta Moriyasu, Hyogo (JP); Kenji Hirata, Hyogo (JP); Takayuki Kogure, Hyogo (JP)

(73) Assignee: ASCIS CORPORATION, Kobe (JP)

( * ) Notice: Subject to any disclaimer, the term of this patent is extended or adjusted under 35 U.S.C. 154(b) by 197 days.

(21) Appl. No.: 17/254,062

(22) PCT Filed: Feb. 28, 2019

(86) PCT No.: PCT/JP2019/007802

§ 371 (c)(1),
(2) Date: Dec. 18, 2020

(87) PCT Pub. No.: WO2020/174654

PCT Pub. Date: Sep. 3, 2020

(65) Prior Publication Data

US 2021/0259355 A1 Aug. 26, 2021

(51) Int. Cl.
*A43B 7/08* (2022.01)
*A43B 23/02* (2006.01)

(52) U.S. Cl.
CPC ..... *A43B 7/082* (2013.01); *A43B 23/0245* (2013.01)

(58) Field of Classification Search
CPC ..... A43B 23/0245; A43B 7/082; A43B 7/08; A43B 7/085; A43B 7/06
(Continued)

(56) References Cited

U.S. PATENT DOCUMENTS 1,763,605 A * 6/1930 Haskell ..... A43B 23/25 36/3 A
2,188,168 A * 1/1940 Winkel ..... A43B 23/0235 36/51

(Continued)

FOREIGN PATENT DOCUMENTS

FR 2856250 A1 * 12/2004 ..... A43B 23/027
JP 54-47546 U 4/1979

(Continued)

OTHER PUBLICATIONS

International Search Report issued May 28, 2019 in corresponding International Patent Application No. PCT/JP2019/007802, filed Feb. 28, 2019 (with English Translation).

(Continued)

*Primary Examiner* — Alissa J Tompkins
*Assistant Examiner* — Catherine M Ferreira
(74) *Attorney, Agent, or Firm* — Global IP Counselors, LLP

(57) ABSTRACT

A shoe includes an upper portion surrounding an internal space configured to accommodate a foot. The upper portion includes an inner foot outer surface of an inner foot portion, and an air sucking out portion from which air is capable of being sucked out from the internal space to outside of the shoe when a leg of a wearer of the shoe swings is disposed on the inner foot outer surface of the inner foot portion of the upper portion. The air sucking out portion extends in a direction which is slanted by a predetermined first angle with respect to a vertical direction when the shoe is placed on a horizontal plane and is recessed relative to the inner foot outer surface.

19 Claims, 10 Drawing Sheets

(58) Field of Classification Search
USPC ..... 36/3 A
See application file for complete search history.

(56) References Cited

U.S. PATENT DOCUMENTS

| | | | | |
|---|---|---|---|---|
| 6,401,364 | B1 | 6/2002 | Burt | |
| 2004/0111918 | A1* | 6/2004 | Van Noy | A43B 7/085 36/3 R |
| 2005/0081402 | A1 | 4/2005 | Orei et al. | |
| 2006/0277785 | A1* | 12/2006 | Vattes | A43B 17/102 36/3 A |
| 2007/0151121 | A1* | 7/2007 | Touzov | F28D 15/046 36/2.6 |
| 2007/0180730 | A1* | 8/2007 | Greene | A43C 1/006 36/3 R |
| 2015/0047230 | A1* | 2/2015 | Beers | A43B 23/047 36/102 |
| 2018/0368525 | A1* | 12/2018 | Luchi | B32B 25/042 |

FOREIGN PATENT DOCUMENTS

| | | | |
|---|---|---|---|
| JP | 60-180511 | U | 11/1985 |
| JP | 7-11901 | | 2/1995 |
| JP | 2004-174257 | A | 6/2004 |
| JP | 2013-220190 | A | 10/2013 |
| JP | 2017-6361 | A | 1/2017 |
| JP | 2019-5387 | A | 1/2019 |

OTHER PUBLICATIONS

Supplementary European Search Report issued Aug. 12, 2022 in corresponding European Application No. 19917084.6.

Chinese Office Action issued Aug. 16, 2022 in corresponding Chinese Application No. 201980039288.4.

https://post.smzdm.com/p/awxl7gdg/; Nike Free RN Flyknit 2018; Nov. 30, 2018; p. 1-22.

* cited by examiner

A-A

B-B

SHOE

CROSS-REFERENCE TO RELATED APPLICATION

This application is a U.S. National Stage application of International Application No. PCT/JP2019/007802, filed Feb. 28, 2019, the contents of which are hereby incorporated herein by reference.

BACKGROUND

Technical Field

The present disclosure relates to shoes worn for sports, and the like.

Background Information

Conventional shoes can include ventilation systems for reducing stuffiness inside the shoe. For example, JP 2004-174257 A discloses a shoe including a ventilation means having a guide piece extending in an opening part. In this shoe, the guide piece is disposed to direct air toward the inside of the opening part of the ventilation means during exercise using the shoe. This guide piece is disposed with a forward gradient with respect to a longitudinal axis of the shoe. This configuration makes the guide piece substantially parallel to the flow of air when the moving speed of the shoe is at its highest, so that it is easy for the air to enter the ventilation means.

SUMMARY

It has been discovered that an improved shoe that reduces stuffiness inside the shoe is desired. When a shoe wearer walks, runs or exercises, stuffiness inside the shoe due to the moisture from sweat produced by the foot can cause discomfort to the wearer. The shoe disclosed in JP 2004-174257 A has a configuration in which air is introduced inside the shoe with a ventilation means including a guide piece. However, it has been found that this shoe has room for improvement in exhausting air inside the shoe.

It has been found that there are points to be further improved particularly with the objective of effectively ventilating inside a shoe while a leg is in a swinging motion.

The present disclosure describes embodiments that have been made in view of such points, and an object of the present disclosure is to provide a shoe which is capable of effectively providing ventilation inside a shoe when a leg swings.

In order to solve the above issues, an embodiment of a shoe according to an aspect of the present invention includes an upper portion surrounding an internal space configured to accommodate a foot, the upper portion including an inner foot outer surface of an inner foot portion, and an air sucking out portion from which air is capable of being sucked out from the internal space to outside of the shoe, when a leg of a wearer of the shoe swings, is disposed on the inner foot outer surface of the inner foot portion of the upper portion, and the air sucking out portion extends in a direction which is slanted by a predetermined first angle with respect to a vertical direction when the shoe is placed on a horizontal plane and is recessed relative to the inner foot outer surface.

Note that arbitrary combinations of the above, a method, an apparatus, a program, a temporary or non-temporary storage medium in which the program is recorded, a system, and the like, among which components and expression of the present invention are mutually substituted are effective as an aspect of the present invention.

According to embodiments of the present invention, a shoe is provided which is capable of effectively ventilating inside the shoe when a leg is in a swinging motion.

BRIEF DESCRIPTION OF THE DRAWINGS

The invention will be explained in more detail hereinafter with reference to the drawings.

DETAILED DESCRIPTION OF EMBODIMENTS

Figure 1:
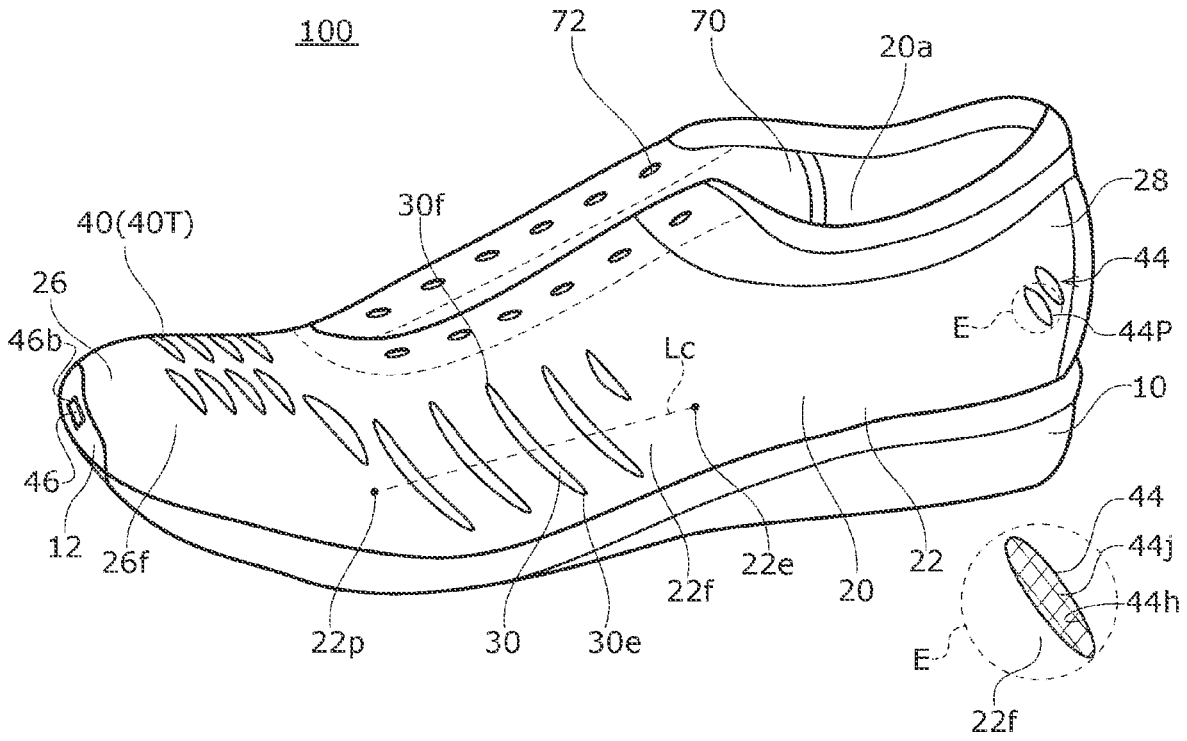
FIG. 1 is a perspective view schematically illustrating a shoe according to an embodiment of the present invention.

The present invention will be described below along with a preferred embodiment with reference to the drawings. In the embodiment and modified examples, the same reference numerals will be assigned to the same or equivalent components and members, and repetitive description will be omitted as appropriate. Further, sizes of members in the respective drawings are increased or reduced as appropriate to facilitate an understanding of the embodiment. Still further, parts of the members which are not important in the description of the embodiment are omitted in the respective drawings.

Further, terms including ordinal numbers such as first and second, which are used to describe a variety of components, are used only for the purpose of distinguishing one component from other components and do not limit the components.

Figure 2:
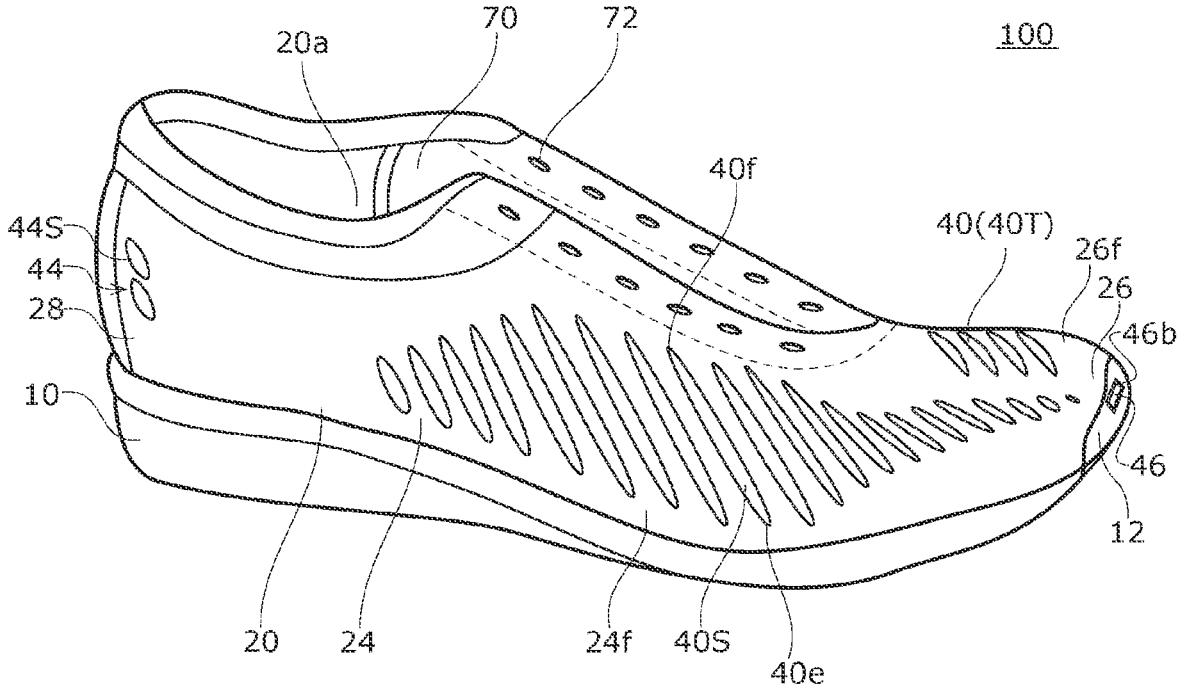
FIG. 2 is another perspective view schematically illustrating the shoe in FIG. 1.
Figure 3:
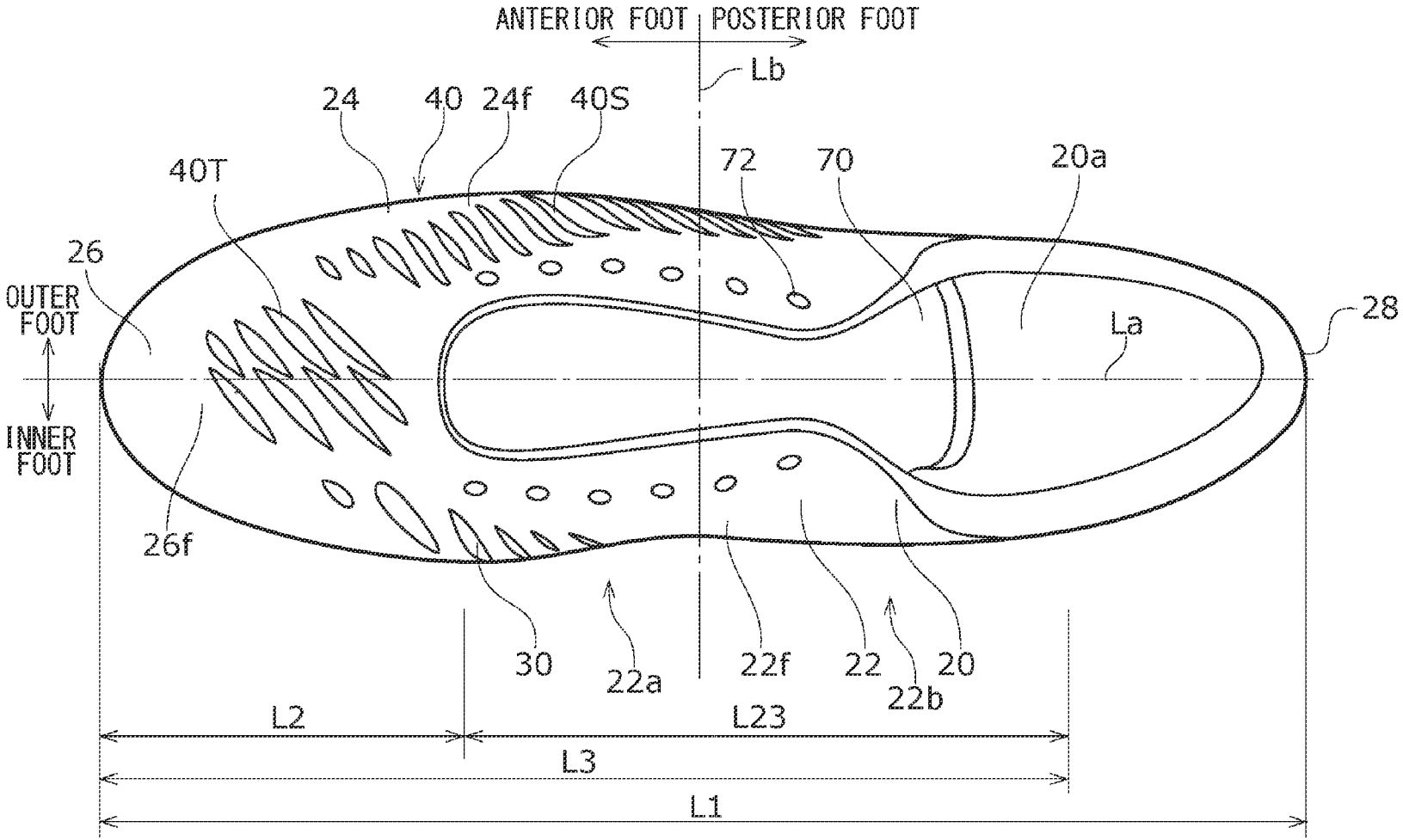
FIG. 3 is a top plan view schematically illustrating the shoe in FIG. 1.

A configuration of a shoe 100 according to the embodiment of the present invention will be described below with reference to the drawings. FIG. 1 is a perspective view schematically illustrating the shoe 100 viewed from an inner foot portion 22. The following drawings including FIG. 1 illustrate a shoe for the right foot unless otherwise described. The description in the present specification is similarly applied to a shoe for the left foot. FIG. 2 is a side view schematically illustrating an air sucking out portion of the shoe 100. FIG. 2 is another perspective view schematically illustrating the shoe 100 viewed from an outer foot side. FIG. 3 is a view schematically illustrating the shoe 100 in a top planar view.

The shoe 100 of the present embodiment can be used as sports shoes for, for example, walking and running. The shoe 100 includes a sole 10 and an upper portion 20. The upper portion 20 surrounds an internal space 20*a* for accommodating a foot. Eyelets 72 through which a shoelace (not illustrated) is to pass are disposed in the upper portion 20. A shoe tongue 70 is disposed on the internal space 20*a* side of the upper portion 20. As illustrated in FIG. 3, an inner foot side (lower portion of the drawing) from a width-direction center line La of the upper portion 20 will be referred to as an inner foot portion 22, and an outer foot side (upper portion of the drawing) from the width-direction center line La will be referred to as an outer foot portion 24. Further, a direction toward the inner foot portion 22 from the outer foot portion 24 will be referred to as inward, and its opposite direction will be referred to as outward.

Further, a front side (left portion of the drawing) from a longitudinal-direction center line Lb will be referred to as an anterior foot portion 22*a* of the upper portion 20, and a back side (right portion of the drawing) from the center line Lb will be referred to as a posterior foot portion 22*b*. Note that the center line La and the center line Lb can be orthogonal to each other. Further, an upper direction in a state where the shoe 100 is placed on a horizontal plane (hereinafter, referred to as a "horizontal state") will be referred to as above or upward, and its opposite direction will be referred to as below or downward.

The upper portion 20 includes an air sucking out portion 30 for sucking out air from the internal space 20*a*, an air intake portion 40 for taking in air into the internal space 20*a*, an air exhausting portion 44 for exhausting air from the internal space 20*a*, an air intake hole 46 for taking in air from the toe, and a shoe tongue concave-convex portion 70*p* which encourages ventilation through the shoe tongue 70.

Figure 4:
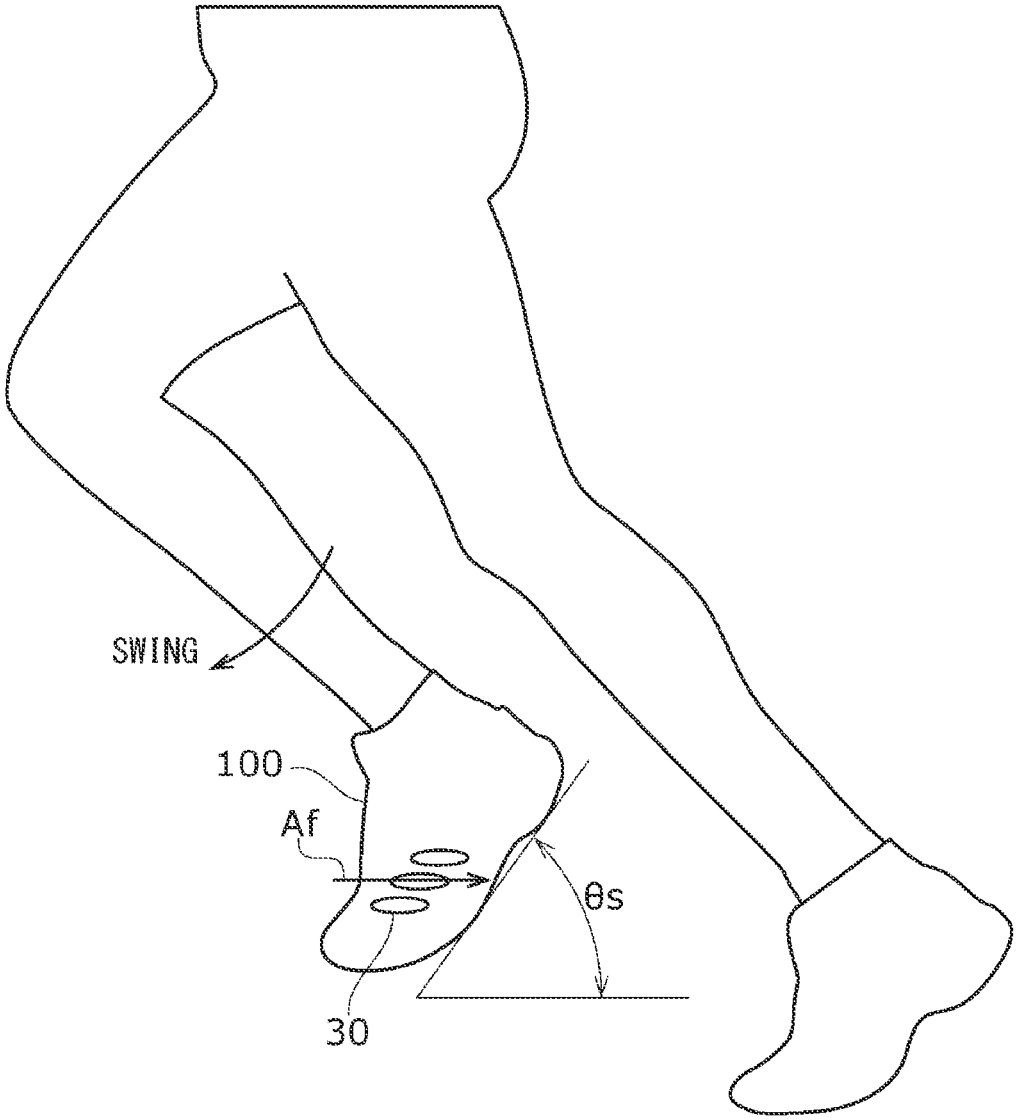
FIG. 4 is a view schematically illustrating a state in which a wearer of the shoe in FIG. 1 is running.

FIG. 4 is a view schematically illustrating a state where a wearer of the shoe 100 is running. As illustrated in FIG. 4, when the wearer walks or runs, the leg on which the shoe 100 is worn swings. When the leg swings, a flow of air (hereinafter, referred to as "airflow Af") relative to a surface of the upper portion 20 occurs.

Figure 5:
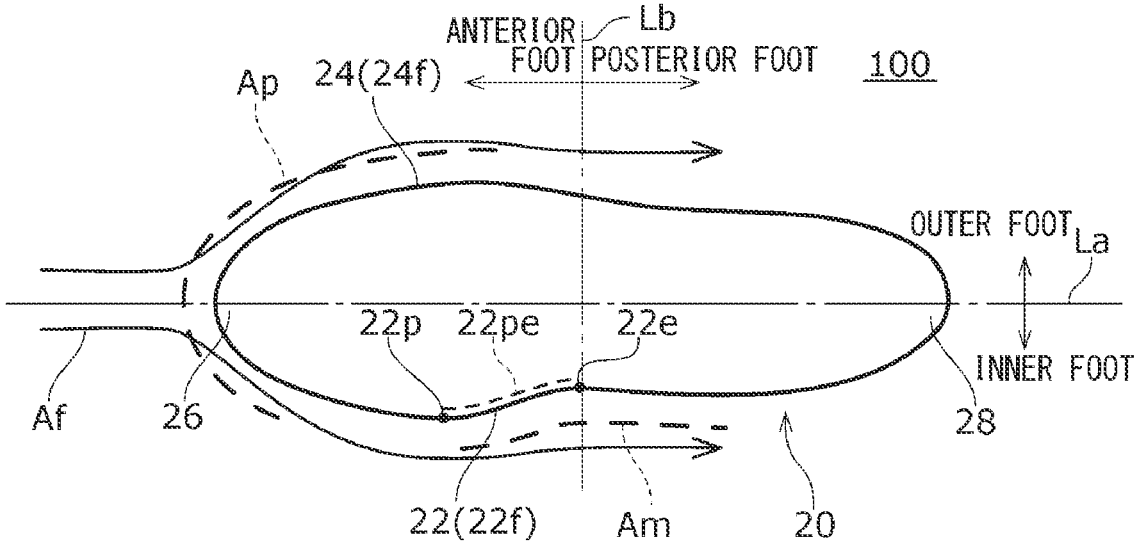
FIG. 5 is a view schematically illustrating the flow of air when the wearer of the shoe in FIG. 1 swings his/her leg.

FIG. 5 is a view schematically illustrating the airflow Af on the surface of the upper portion 20 when the wearer of the shoe 100 swings his/her leg in a planar view. A difference in speed of the airflow Af occurs by an irregular surface when the airflow Af flows along the surface of the upper portion 20. A low pressure region Am in which a pressure is lowered in accordance with a difference in speed of the airflow Af and a high pressure region Ap in which the pressure increases occur on the surface of the upper portion 20. For example, the low pressure region Am can occur posterior to a portion near a bulge portion corresponding to the ball of the foot on an inner foot outer surface 22*f* of the inner foot portion 22 of the upper portion 20. For example, the high pressure region Ap can occur from a toe portion 26 toward an outer foot outer surface 24*f* of the outer foot portion 24 of the upper portion 20.

Air Sucking Out Portion

Figure 6:
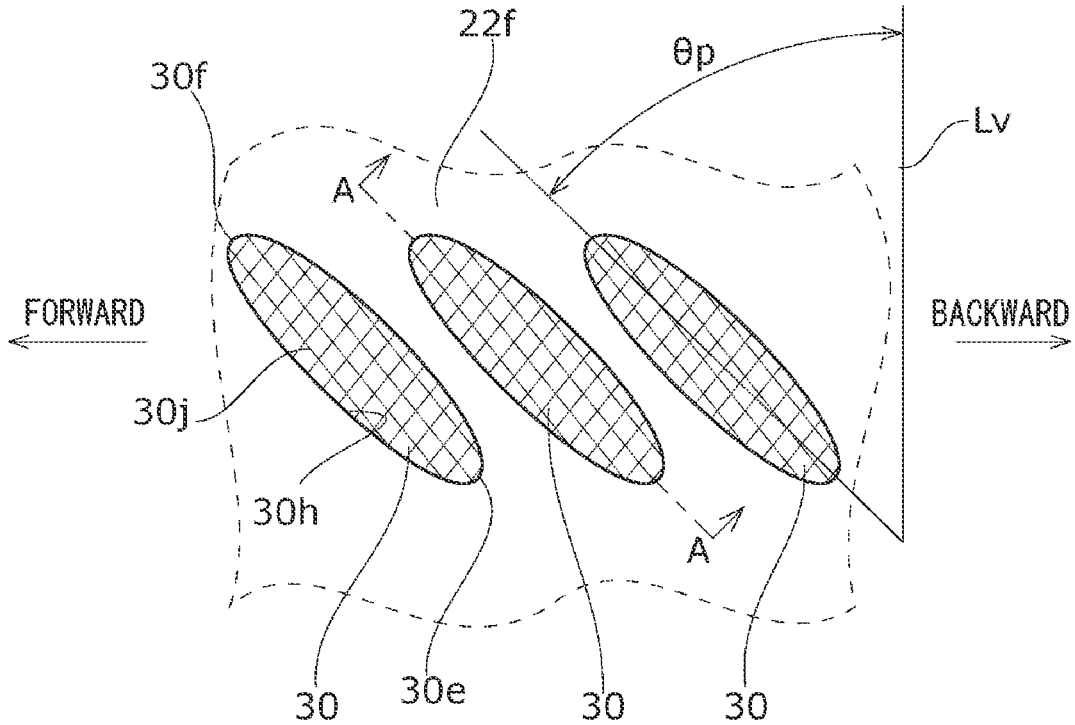
FIG. 6 is a view schematically illustrating an air sucking out portion of the shoe in FIG. 1.
Figure 7:
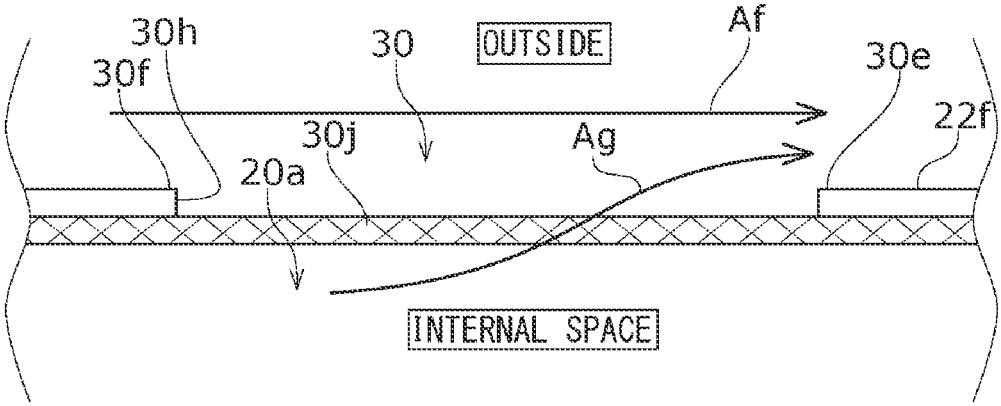
FIG. 7 is a cross-sectional diagram schematically illustrating the air sucking out portion of the shoe in FIG. 1.

The air sucking out portion 30 will now be described. FIG. 6 is a view schematically illustrating the air sucking out portion 30. FIG. 7 is a cross-sectional diagram of the air sucking out portion 30 cut along line A-A in FIG. 6. In the present embodiment, a plurality of air sucking out portions 30 is disposed on the inner foot outer surface 22*f* of the inner foot portion 22 of the upper portion 20. The air sucking out portion 30 has a ventilation structure which enables ventilation between the internal space 20*a* and outside air. Air Ag in the internal space 20*a* is sucked out to the outside through the air sucking out portion 30 by negative pressure that occurs on the surface of the upper portion 20 when the wearer of the shoe 100 swings his/her leg (see FIG. 7).

As illustrated in FIG. 6, the air sucking out portions 30 extend in a tilting or slanted manner by a predetermined first angle θp with respect to a vertical line Lv when the shoe 100 is placed in a horizontal state. The first angle θp will be described later. The air sucking out portion 30 of the present embodiment has a slit shape, e.g., a rectangle, an oval, or the like, which is elongated in an extending direction, that is, in a longitudinal direction in a side view. In the present embodiment, a plurality of air sucking out portions 30 is arranged such that the air sucking out portions are substantially parallel to each other. The slit shape of the air sucking out portion 30 is not limited to a rectangle or an oval and can be any other shapes, such as a meandering shape or a trapezoid shape. For example, the air sucking out portion 30 can have a configuration in which a plurality of punching holes are obliquely disposed. In these embodiments, it is only necessary that lines connecting centers of respective anterior edges and posterior edges tilt or slant by the first angle θp. A ratio of the length in the longitudinal direction with respect to the length in a lateral direction is, for example, equal to or greater than 110%, preferably, equal to or greater than 150%, and, more preferably, equal to or greater than 200%.

As illustrated in FIG. 7, the air sucking out portion 30 is recessed or indented relative to the inner foot outer surface 22*f*. In the present embodiment, the air sucking out portion 30 includes an opening 30*h* disposed on the inner foot outer surface 22*f*, and a meshed body 30*j* disposed on the internal space 20*a* side of the opening 30*h*. The air sucking out portion 30 can be a simple opening, and the meshed body 30*j* is disposed at the opening 30*h* with the objective of reducing entrance of sand or pebbles and reinforcing the opening. In this embodiment, the air sucking out portion 30 has a structure in which the meshed body 30*j* is laminated on the internal space 20*a* side of the inner foot outer surface 22*f* on which the opening 30*h* is disposed. A difference in level between the inner foot outer surface 22*f* and the meshed body 30*j* preferably falls within a range between 0.1 mm and 20 mm with the objective of effectively sucking out air.

The inner foot outer surface 22*f* on which the opening 30*h* is disposed and the meshed body 30*j* can be separately formed and can be pasted by adhesion, or the like. In the present embodiment, the inner foot outer surface 22*f* on which the opening 30*h* is disposed and the meshed body 30*j* are formed through a weave which enables a thick region and a thin region to be integrally formed. For example, the inner foot outer surface 22*f* on which the opening 30*h* is disposed and the meshed body 30*j* can be integrally formed through jacquard a weave or jacquard knitting. The air sucking out portion 30 in this example is a relief-shaped recessed portion which is formed through a jacquard weave or jacquard knitting.

Specifications such as an aperture ratio, mesh opening, a wire diameter, and the number of meshes of the meshed body 30*j* can be determined through experiments and simulation in accordance with desired air resistance and desired dust-proof performance. For example, in an embodiment in which the air sucking out portion 30 is formed through a jacquard weave, sufficient ventilation characteristics can be achieved by flat knitting, or the like, in which the meshed body 30*j* is knitted with a knitting machine of 26 gauge using a string having a diameter of 80 deniers. Meanwhile, a material knitted with a string having a diameter which is approximately twice the diameter of the meshed body 30*j* can be used as the inner foot outer surface 22*f*. In this embodiment, the inner foot outer surface 22*f* only requires a ventilation rate of approximately 250 $cm^3/(cm^2 \cdot s)$ in a Frazier type air permeability test specified in JISL1096, and the meshed body 30*j* preferably has a further higher ventilation rate. The specifications are not limited to those described above, and there can be visible differences between the meshed body 30*j* and the inner foot outer surface 22*f* in specifications such as an aperture ratio, mesh opening, a wire diameter and the number of meshes.

The air sucking out portion 30 is preferably disposed in a region in which negative pressure is likely to occur. As illustrated in FIG. 3, it is apparent that a region which cannot be seen when viewed from the front in a direction along the width-direction center line La of the shoe 100 on the inner foot outer surface 22*f* is a region where the airflow Af is blocked by the toe portion 26, and thus, negative pressure is likely to occur. The air sucking out portion 30 can therefore include a portion which is disposed in a region which cannot be seen when viewed from the front in the direction along the width-direction center line La of the shoe 100 on the inner foot outer surface 22*f*. In other words, the air sucking out portion 30 can include a portion which is disposed in a region which cannot be seen when viewed from the front of the shoe 100.

As a result of study by the present inventors, it is indicated that when the length L1 from the toe portion 26 to a heel portion 28 of the upper portion 20 is set to 100%, in the air sucking out portion 30, a negative pressure is likely to occur in a longitudinal region L23 from a position L2 which is 30% from the toe portion 26 to a position L3 which is 80% from the toe portion 26 on the anterior foot portion 22*a* of the inner foot outer surface 22*f* (see FIG. 3). The air sucking out portion 30 of the present embodiment therefore includes a portion which is disposed in a longitudinal region located at equal to or greater than 30% and equal to or less than 80% from the toe portion 26.

As a result of study by the present inventors it has been found that negative pressure is likely to occur particularly in a longitudinal-direction range 22*pe* specified by an innermost point 22*e* located at the innermost area of the inner foot outer surface 22*f* and an outermost point 22*p* located at the outermost area of the inner foot outer surface 22*f* in a top planar view on the anterior foot portion 22*a* (see FIG. 3). In other words, negative pressure is likely to occur in a range 22*pe* from the innermost point 22*e* to the outermost point 22*p*. The air sucking out portion 30 of the present embodiment therefore includes a portion disposed in the range 22*pe*.

As illustrated in FIG. 4, the airflow Af flows from an anterior upper portion to a posterior lower portion of the shoe 100 when the shoe wearer's leg swings. The air sucking out portion 30 therefore is slanted downward toward a posterior portion along the direction of the airflow Af so as to efficiently suck out air. In other words, the posterior edge 30*e* in the extending direction of the air sucking out portion 30 is positioned below the anterior edge 30*f*. In this embodiment, as illustrated in FIG. 1, the posterior edge 30*e* of the air sucking out portion 30 is positioned below a line Lc connecting the innermost point 22*e* and the outermost point 22*p* of the upper portion 20, and the anterior edge 30*f* of the air sucking out portion 30 is positioned above the line Lc.

Figure 8:
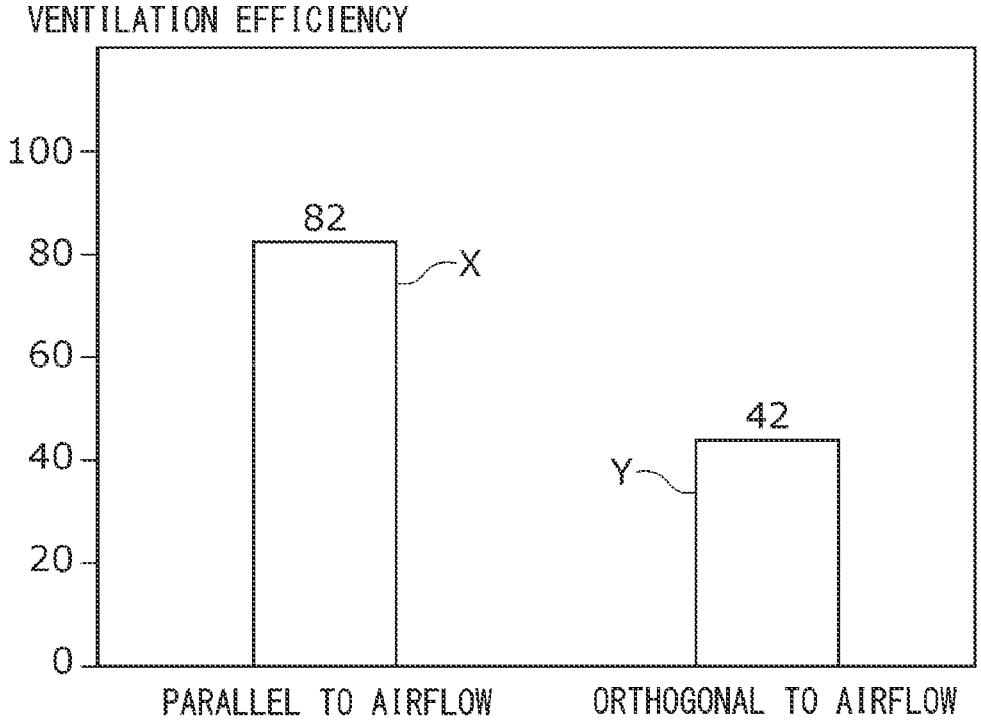
FIG. 8 is a graph indicating the relationship between an angle of the air sucking out portion of the shoe in FIG. 1 and ventilation characteristics.

FIG. 8 is a bar graph indicating a result of a study by the present inventors regarding the relationship between an angle formed by the extending direction of the air sucking out portion 30 and the direction of the airflow Af, and ventilation characteristics of the air sucking out portion 30. Note that the ventilation characteristics of the air sucking out portion 30 are defined as an amount of air ventilated per unit time when the swinging motion of the leg is simulated and the shoe 100 faces opposing wind from the front. FIG. 8 indicates the ventilation characteristics expressed with a relative ratio when a reference value set in advance is set as 100 on a vertical axis, and a greater numerical value indicates more favorable ventilation characteristics. In FIG. 8, X indicates a configuration in which the extending direction of the air sucking out portion 30 is parallel to the direction of the airflow Af, in this configuration the ventilation efficiency is 82. Further, Y indicates a configuration in which the extending direction of the air sucking out portion 30 is orthogonal to the direction of the airflow Af, in this configuration the ventilation efficiency is 42.

It has been found from the result that the ventilation characteristics in a configuration in which the extending direction of the air sucking out portion 30 is parallel to the direction of the airflow Af is approximately twice as favorable as the ventilation characteristics in a configuration in which the extending direction of the air sucking out portion 30 is orthogonal to the direction of the airflow Af. This may be because, in a configuration in which the extending direction of the air sucking out portion 30 is orthogonal to the direction of the airflow Af, the airflow Af mainly collides with a long side of the opening 30*h*, at which a pressure locally increases and a sucking out effect decreases. Alternatively, this may be because, in a configuration in which the extending direction of the air sucking out portion 30 is orthogonal to the direction of the airflow Af, turbulence of the airflow Af is large at the opening 30*h*, and the sucking out effect decreases. From these results, it is apparent that the air sucking out portion 30 extending in a direction substantially parallel to the direction of the airflow Af is preferred to improve ventilation characteristics.

Figure 9:
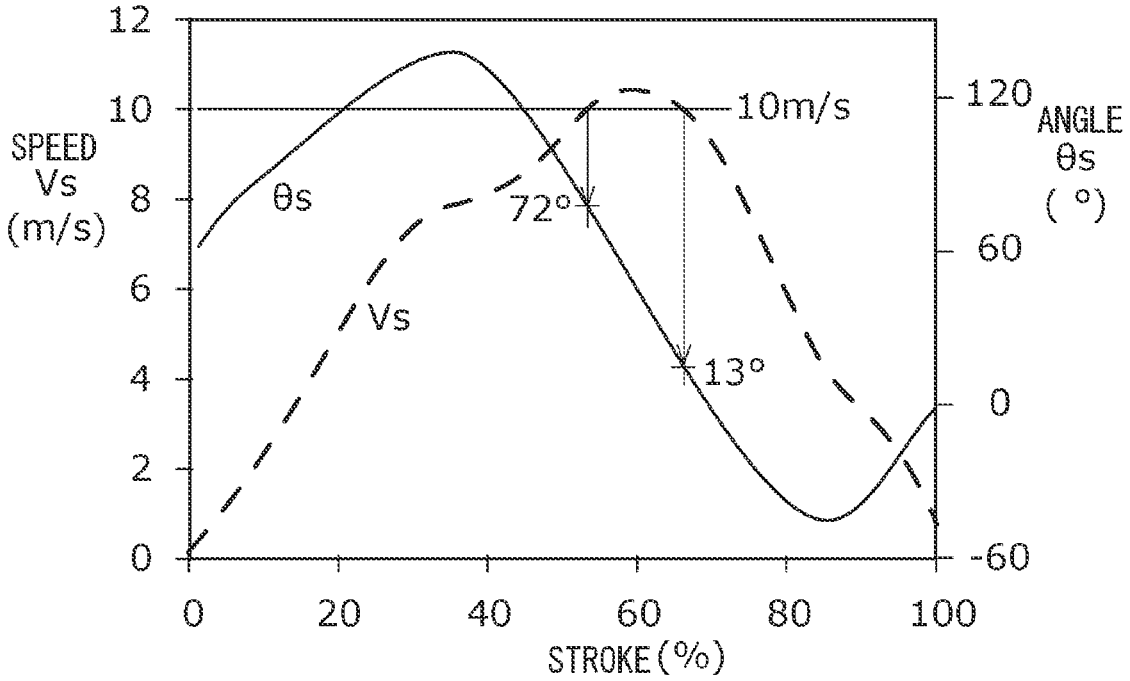
FIG. 9 is a graph indicating an angle with respect to a swing position of the shoe in FIG. 1 and swing speed.
Figure 10:
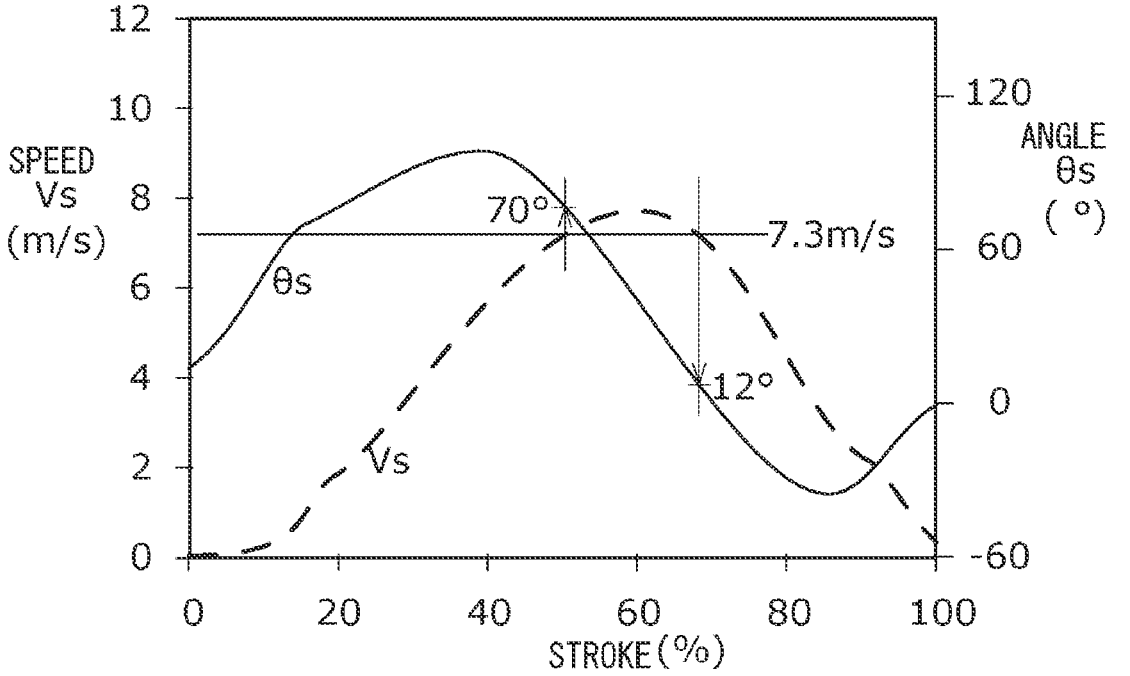
FIG. 10 is another graph indicating the angle with respect to the swing position of the shoe in FIG. 1 and the swing speed.

The extending direction of the air sucking out portion 30 is preferably parallel to the direction of the airflow Af when the swing speed of the leg is high with the objective of improving ventilation characteristics. FIG. 9 and FIG. 10 are graphs indicating relationship between an angle θs of the shoe 100 with respect to a swing position of the leg and swing speed Vs of the shoe 100. FIG. 9 indicates a situation in which a wearer of the shoe is running at 17 km/h, and FIG. 10 indicates a situation in which a wearer of the shoe is running at 12 km/h.

Note that the angle θs of the shoe 100 is indicated as a positive numerical value in a situation in which the heel portion 28 rotates counterclockwise around the toe portion 26 in a side view and indicated as a negative numerical value in a situation in which the heel portion 28 rotates clockwise assuming that the angle θs in a state where the shoe 100 is placed on a horizontal plane is 0° as illustrated in FIG. 4. Further, the swing speed Vs of the shoe 100 indicates the speed in a direction of a tangent of the shoe 100 which swings.

FIG. 9 and FIG. 10 indicate a stroke position of the shoe 100 in a situation in which a stroke of one cycle of the swinging of the leg is set as 100% on a horizontal axis. FIG. 9 and FIG. 10 indicate the swing speed Vs of the shoe 100 corresponding to a left vertical axis with a dashed line and indicate the angle θs of the shoe 100 corresponding to a right vertical axis with a solid line.

As a result of the study, as illustrated in FIG. 9, in a situation in which a wearer of the shoe is running at 17 km/h, the swing speed Vs is equal to or higher than 95% (equal to or higher than 10 m/s) of peak speed in a range of the angle θs from 72° to 13°. Further, as illustrated in FIG. 10, in a situation in which a wearer of the shoe is running at 12 km/h, the swing speed Vs is equal to or higher than 95% (equal to or higher than 7.3 m/s) of the peak speed in a range of the angle θs from 70° to 12°. It is apparent from this result that a swing speed Vs equal to or higher than 95% of the peak speed can be obtained in a range of the angle θs of the shoe 100 from 70° to 20° from both running speed. In other words, it is apparent that the angle θs of the shoe 100 is 45°±25° when the swing speed Vs is close to the peak speed.

A first angle θp of the extending direction of the air sucking out portion 30 with respect to a vertical line Lv will be described. Here, the first angle θp is indicated with a positive numerical value in a situation in which the air sucking out portion 30 rotates counterclockwise so that the anterior edge 30*f* is slanted forward in a side view as illustrated in FIG. 6, and is indicated with a negative numerical value in a situation in which the air sucking out portion 30 rotates clockwise so that the anterior edge 30*f* is slanted backward, assuming that the first angle θp in a state where the anterior edge 30*f* is located immediately above the posterior edge 30*e* centering around the posterior edge 30*e* of the air sucking out portion 30 is set as 0°.

As described above, in a situation in which the angle θs of the shoe 100 falls within a range from 70° to 20°, the extending direction of the air sucking out portion 30 is preferably substantially parallel to the direction of the airflow Af. To achieve this condition, in the present embodiment, the first angle θp is set within a range from 20° to 70°, and the anterior edge 30*f* in the extending direction is located above the posterior edge 30*e* in a horizontal state. In this configuration, the extending direction of the air sucking out portion 30 is substantially parallel to the direction of the airflow Af in a state where the swing speed Vs is close to the peak speed, so that the negative pressure can be effectively utilized.

Air Intake Portion

Figure 11:
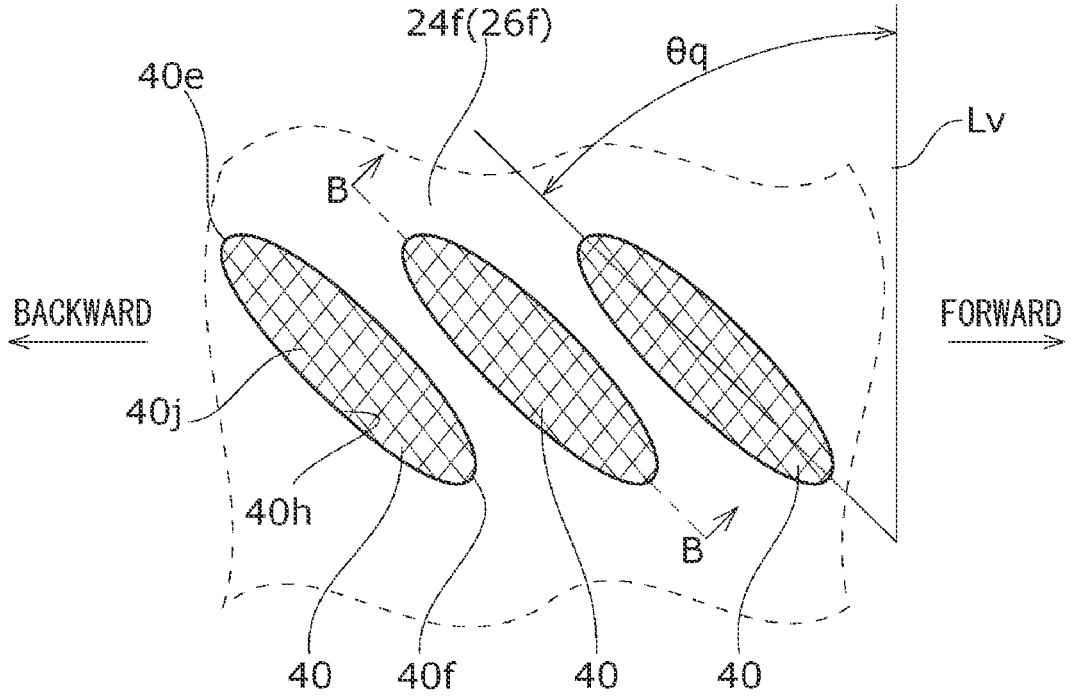
FIG. 11 is a view schematically illustrating an air intake portion of the shoe in FIG. 1.
Figure 12:
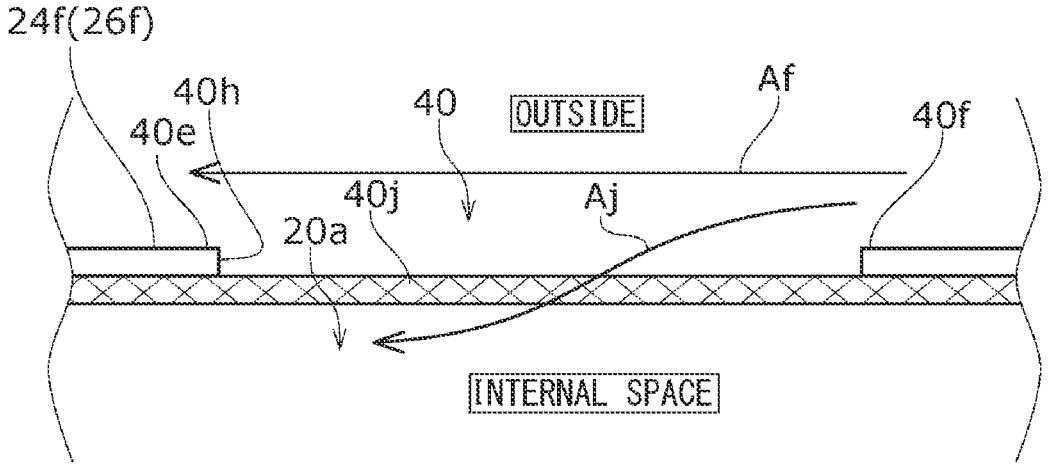
FIG. 12 is a cross-sectional diagram schematically illustrating the air intake portion of the shoe in FIG. 1.

The air intake portion 40 will be described with reference to FIG. 11 to FIG. 13. FIG. 11 is a view schematically illustrating the air intake portion 40. FIG. 12 is a cross-sectional diagram of the air intake portion 40 cut along a line B-B in FIG. 11. As illustrated in FIG. 12, the air intake portion 40 functions as a ventilation portion for taking in outside air Aj into the internal space 20*a*. Particularly, the air intake portion 40 is disposed in the high pressure region Ap in which pressure increases in accordance with the difference in speed of the airflow Af when the wearer who wears the shoe 100 swings his/her leg, and has a configuration which enables air to be efficiently introduced with this pressure.

The air intake portion 40 is disposed on an outer surface other than the inner foot outer surface 22*f* on the outer surface of the upper portion 20. For example, the airflow Af hits a region which can be viewed from the front of the upper portion 20 when the leg swings, and thus, the air intake portion 40 can include a portion disposed in a region which can be viewed from the front of the shoe 100. In the present embodiment, as illustrated in FIG. 3, the air intake portion 40 includes a first air intake portion 40T disposed on a toe outer surface 26*f* at the toe portion 26, and a second air intake portion 40S disposed on an outer foot outer surface 24*f* of the outer foot portion 24. That is because the high pressure region Ap is likely to occur from the toe outer surface 26*f* to the outer foot outer surface 24*f* of the outer foot portion 24. The toe outer surface 26*f* and the outer foot outer surface 24*f* will be collectively referred to as an intake portion outer surface.

The air intake portion 40 of the present embodiment has a slit shape of a rectangle, an oval, or the like, which is elongated in the extending direction, that is, in the longitudinal direction in side view. As illustrated in FIG. 3, a plurality of first air intake portions 40T is arranged such that the first air intake portions 40T are substantially parallel to each other on the toe outer surface 26*f*. Further, as illustrated in FIG. 2, a plurality of second air intake portions 40S is arranged such that the second air intake portions 40S are substantially parallel to each other on the outer foot outer surface 24*f*. The slit shape of the air intake portion 40 is not limited to a rectangle or an oval and can be any other shapes such as a meandering shape and a trapezoid shape. For example, the air sucking out portion 30 can have a configuration where a plurality of punching holes is obliquely disposed. In these embodiments, it is only necessary that lines connecting centers of respective anterior edges and posterior edges are slanted by a predetermined angle. A ratio of the length in the longitudinal direction with respect to the length in a lateral direction is, for example, equal to or greater than 110%, preferably, equal to or greater than 150%, and, more preferably, equal to or greater than 200%.

The air intake portion 40 has a ventilation structure which enables ventilation between the internal space 20*a* and the outside air. As illustrated in FIG. 12, the air intake portion 40 is recessed relative to an intake portion outer surface. In the present embodiment, the air intake portion 40 includes an opening 40*h* disposed on the intake portion outer surface, and a meshed body 40*j* disposed on the internal space 20*a* side of the opening 40*h*. The air intake portion 40 can be a simple opening, and the meshed body 40*j* is disposed at the opening 40*h* with the objective of reducing entrance of sand or pebbles and reinforcing the opening. In this embodiment, the air intake portion 40 has a structure in which the meshed body 40*j* is laminated on the internal space 20*a* side of the intake portion outer surface on which the opening 40*h* is disposed. The difference in level between the outer foot outer surface 24*f* and the meshed body 40*j* preferably falls within a range between 0.1 mm and 20 mm with the objective of effectively intaking air.

The intake portion outer surface on which the opening 40*h* is disposed and the meshed body 40*j* can be separately formed and pasted with adhesion, or the like. In the present embodiment, the intake portion outer surface on which the opening 40*h* is disposed and the meshed body 40*j* are integrally formed through a jacquard weave or jacquard knitting. In other words, the air intake portion 40 is formed through a jacquard weave or jacquard knitting.

Specifications such as an aperture ratio, mesh opening, a wire diameter, and the number of meshes of the meshed body 40*j* can be determined through experiments and simulation in accordance with desired air resistance and desired dust-proof performance. With the objective of facilitating manufacturing, specifications such as an aperture ratio, mesh opening, a wire diameter, the number of meshes of the meshed body 40*j* can be the same as those of the meshed body 30*j*. As described above, in an embodiment where the air sucking out portion 30 is formed through a jacquard weave, sufficient ventilation characteristics can be achieved by flat knitting, or the like, in which the meshed body 40*j* is knitted with a knitting machine of 26 gauge using a string having a diameter of 80 deniers.

Meanwhile, a material knitted with a string having a diameter which is approximately twice the diameter of the meshed body 40*j* can be used as the outer foot outer surface 24*f* and the toe outer surface 26*f*. In this embodiment, the outer foot outer surface 24*f* and the toe outer surface 26*f* are only required to have a ventilation rate of approximately 250 $cm^3/(cm^2 \cdot s)$ in a Frazier type air permeability test specified in JISL1096, and the meshed body 40*j* preferably has a further higher ventilation rate. The specifications are not limited to those described above, and there can be visible differences between the meshed body 40*j*, and the outer foot outer surface 24*f* and the toe outer surface 26*f* in specifications such as an aperture ratio, mesh opening, a wire diameter and the number of meshes.

Figure 13:
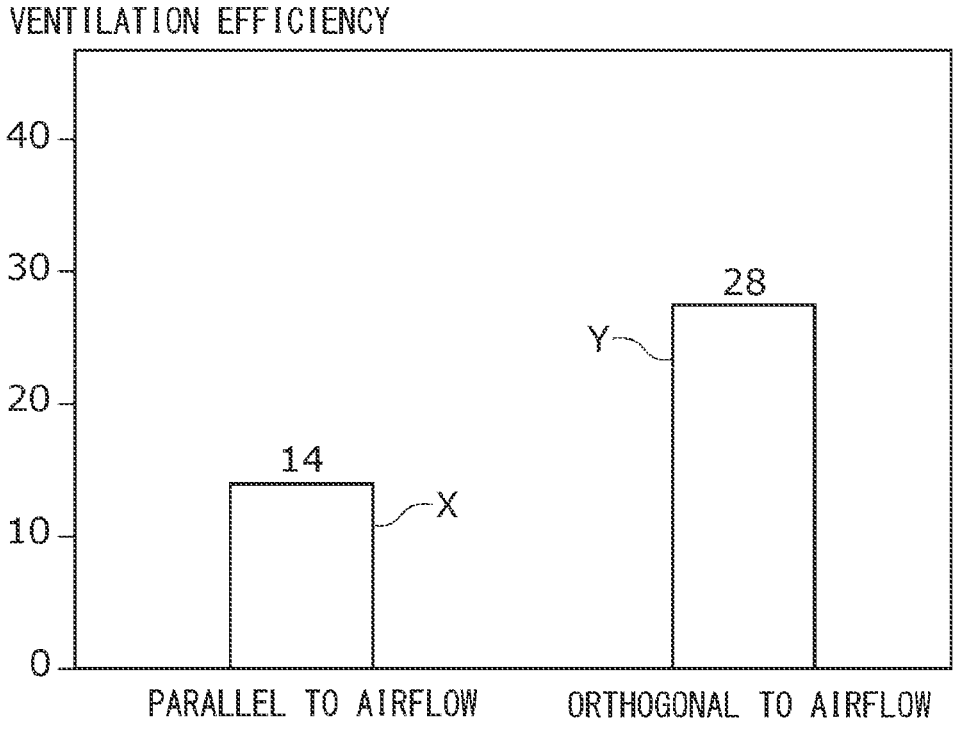
FIG. 13 is a graph indicating the relationship between an angle of the air intake portion of the shoe in FIG. 1 and ventilation characteristics.

FIG. 13 is a bar graph indicating a result of a study by the present inventors regarding the relationship between an angle formed by the extending direction of the air intake portion 40 and the direction of the airflow Af, and ventilation characteristics of the air intake portion 40. Note that the ventilation characteristics of the air intake portion 40 are defined as an amount of air ventilated per unit time when swing of the leg is simulated and the shoe 100 faces opposing wind from the front. FIG. 13 indicates the ventilation characteristics expressed with a relative ratio when a reference value set in advance is set as 100 on a vertical axis, and a greater numerical value indicates more favorable ventilation characteristics. In FIG. 13, X indicates an embodiment in which the extending direction of the air intake portion 40 is parallel to the direction of the airflow Af, in which embodiment the ventilation efficiency is 14. Further, Y indicates an embodiment in which the extending direction of the air intake portion 40 is orthogonal to the direction of the airflow Af, in which embodiment the ventilation efficiency is 28.

It has been found from the result that ventilation characteristics in an embodiment in which the extending direction of the air intake portion 40 is orthogonal to the direction of the airflow Af are approximately twice as favorable as the ventilation characteristics in an embodiment in which the extending direction of the air intake portion 40 is parallel to the direction of the airflow Af. This may be because, in an embodiment in which the extending direction of the air intake portion 40 is orthogonal to the direction of the airflow Af, the airflow Af mainly collides with a long side of the opening 40*h*, at which a pressure locally increases, and an intake effect is improved. From these, the air intake portion 40 preferably extends in a direction substantially orthogonal to the direction of the airflow Af to improve ventilation characteristics.

The extending direction of the first air intake portion 40T will be described. With the objective of improving ventilation characteristics, the first air intake portion 40T can extend in a width direction at the toe portion 26. In this embodiment, the extending direction of the first air intake portion 40T is substantially orthogonal to the direction of the airflow Af, so that air can be efficiently taken in.

The extending direction of the second air intake portion 40S will be described. With the objective of improving ventilation characteristics, the extending direction of the second air intake portion 40S is preferably substantially orthogonal to the direction of the airflow Af at an angle θs (45°±25°) of the shoe 100 in a state where the swing speed Vs is close to peak speed. The second air intake portion 40S of the present embodiment therefore is slanted so that an anterior edge 40*f* in the extending direction is located below a posterior edge 40*e* in a horizontal state. In other words, the second air intake portion 40S is slanted downward toward an anterior portion so as to substantially orthogonal to the direction of the airflow Af. A slant angle θq of the second air intake portion 40S with respect to the vertical line Lv can fall within a range from 20° to 70°. In this embodiment, the extending direction of the second air intake portion 40S is substantially orthogonal to the direction of the airflow Af in a state in which the swing speed Vs is close to the peak speed, so that air can be efficiently taken in.

Air Exhausting Portion

The air exhausting portion 44 will be described with reference to FIG. 1 and FIG. 2. As illustrated in FIG. 1 and FIG. 2, the air exhausting portion 44 of the present embodiment is disposed at the heel portion 28 of the upper portion 20. The air exhausting portion 44 functions as a ventilation portion which is capable of exhausting air in the internal space 20*a*. The air exhausting portion 44 includes a first air exhausting portion 44P disposed on a heel side of the inner foot outer surface 22*f*, and a second air exhausting portion 44S disposed on a heel side of the outer foot outer surface 24*f*. The air exhausting portion 44 has a slit shape in the shape of a rectangle, an oval, or the like, which is elongated in the extending direction. The first air exhausting portion 44P is slanted in the same direction as the slant direction of the air sucking out portion 30, and the second air exhausting portion 44S is slanted in the same direction as the slant direction of the second air intake portion 40S.

The air exhausting portion 44 is recessed relative to the outer surfaces 22*f* and 24*f* and includes an opening 44*h* and a meshed body 44*j* disposed on the internal space 20*a* side. The opening 44*h* has characteristics similar to the characteristics of the opening 30*h*, and the meshed body 44*j* has characteristics similar to the characteristics of the meshed body 30*j*. With the objective of facilitating manufacturing, specifications such as an aperture ratio, mesh opening, a wire diameter and the number of meshes of the meshed body 44*j* can be the same as those of the meshed body 30*j*. Further, in an embodiment in which a heel counter is disposed at the heel portion 28, part of the heel counter can be cut out and the air exhausting portion 44 can be disposed at the cutout portion.

Figure 14:
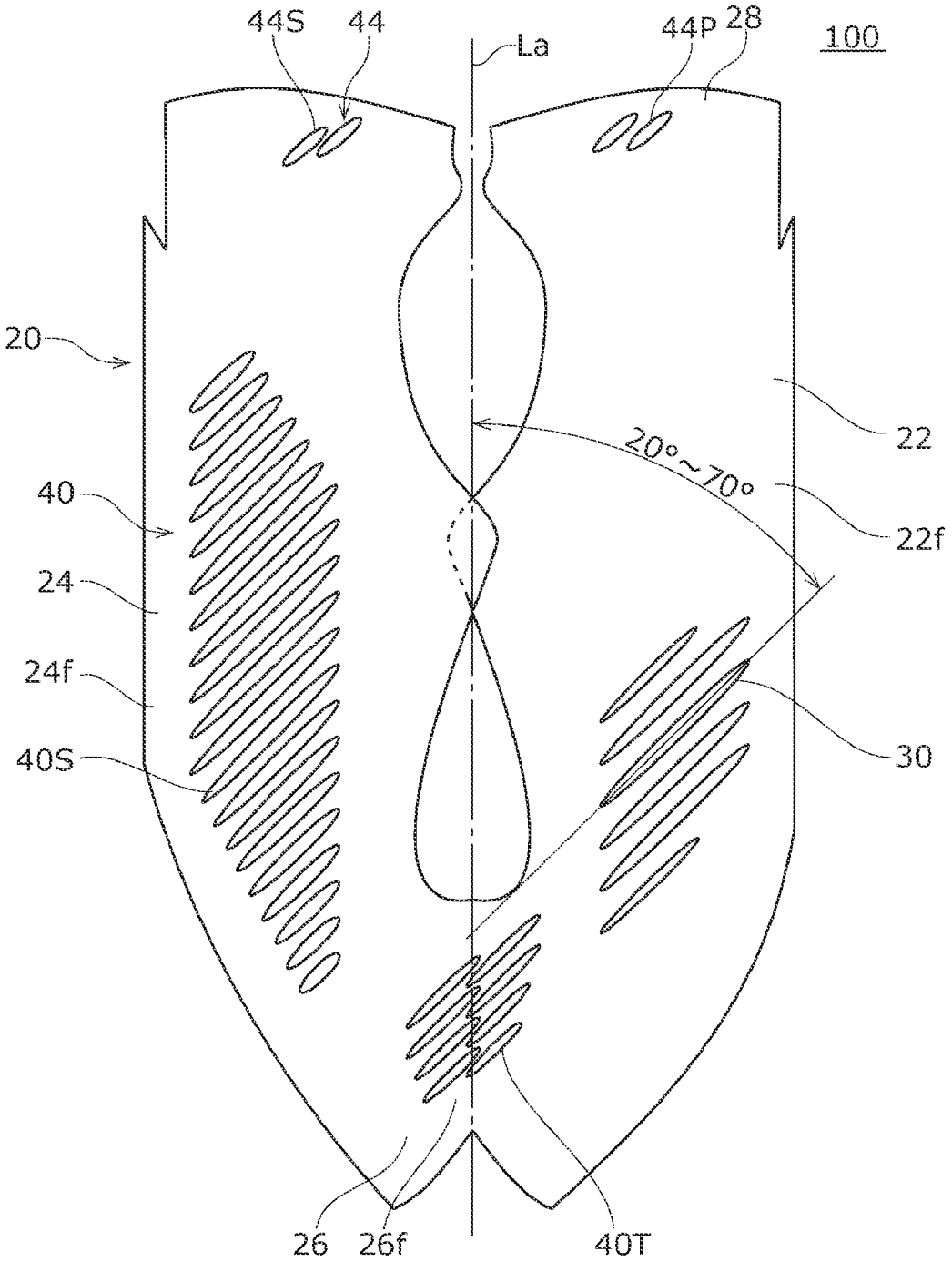
FIG. 14 is a view schematically illustrating a state in which an upper of the shoe in FIG. 1 is developed on a plane.

FIG. 14 is a developed view schematically illustrating a state in which the upper portion 20 is developed on a plane. With the objective of facilitating manufacturing, the first air intake portion 40T and the second air intake portion 40S can extend in the same direction as the extending direction of the air sucking out portion 30 in a state in which the upper portion 20 is developed on a plane. Further, the air exhausting portion 44 can extend in the same direction as the extending direction of the air sucking out portion 30 in a state in which the upper portion 20 is developed on a plane. In the present embodiment, the air sucking out portion 30, the first air intake portion 40T, the second air intake portion 40S and the air exhausting portion 44 slant in the same direction within a range from 20° to 70° with respect to the center line La. The air sucking out portion 30, the first air intake portion 40T, the second air intake portion 40S and the air exhausting portion 44 are integrally formed with the upper portion 20 through a jacquard weave or jacquard knitting.

Shoe Tongue Concave-Convex Portion

Figure 15:
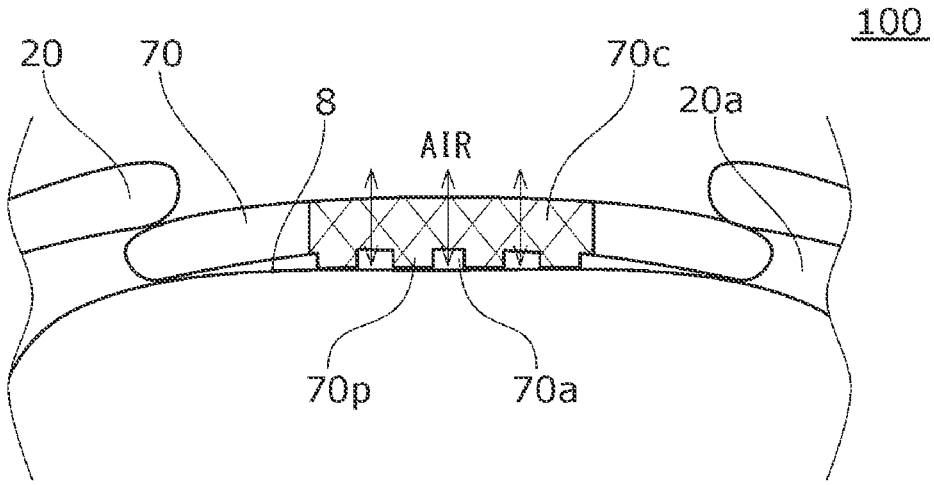
FIG. 15 is a rear view illustrating a portion around a tongue of the shoe in FIG. 1.

The shoe tongue concave-convex portion 70*p* will be described with reference to FIG. 15. FIG. 15 is a rear view illustrating a portion around the shoe tongue 70. In an embodiment in which the shoe tongue tightly adheres to the top of the foot 8, this portion is likely to get stuffy. Thus, in the present embodiment, a concave-convex portion 70*p* is disposed on the internal space 20*a* side of the shoe tongue 70, and the concave-convex portion 70*p* is formed so as to enable ventilation in a thickness direction (vertical direction) of the shoe tongue 70. In other words, the shoe tongue 70 has a ventilation portion 70*c* which is formed with a material which enables ventilation in the thickness direction at a central portion of the width direction (horizontal direction in FIG. 15), and the concave-convex portion 70*p* is disposed on a surface on the internal space 20*a* side of the ventilation portion 70*c*. The ventilation portion 70*c* can be formed with a porous material such as a foam resin.

The concave-convex portion 70*p* forms a concave-convex portion space 70*a* between the top of the foot 8 and the shoe tongue 70 and ventilates air in the concave-convex portion space 70*a* to the outside via the concave-convex portion 70*p*. The shape of the concave-convex portion 70*p* can be determined through simulation or experiments in accordance with desired ventilation characteristics.

Air Intake Hole

The air intake hole 46 will be described with reference to FIG. 1 and FIG. 2. As illustrated in FIG. 1 and FIG. 2, the air intake hole 46 of the present embodiment is formed so as to penetrate part of an outsole 12 rolled up to the toe portion 26 of the upper portion 20 in a longitudinal direction. The air intake hole 46 functions as a ventilation portion which is capable of taking in air into the internal space 20*a*. The air intake hole 46 of the present embodiment has a substantially rectangular shape which is horizontally long in the front view. A reinforcing rib 46*b* can be disposed around the air intake hole 46. A lower edge of the air intake hole 46 of the present embodiment is disposed above an innersole or a shoe insole (upper surface inside the shoe). Providing the air intake hole 46 enables air to be taken in also from the front of the shoe 100, so that ventilation performance can be improved.

An overview of one aspect of the present invention is explained. The shoe 100 according to an aspect of the present invention includes the upper portion 20 surrounding the internal space 20*a* for accommodating a foot. The air sucking out portion 30 from which air is sucked out from the internal space 20*a* to the outside when a leg of the wearer of the shoe swings is disposed on the inner foot outer surface 22*f* of the inner foot portion 22 of the upper portion 20, and the air sucking out portion 30 extends in a direction which is slanted by the predetermined first angle θp with respect to a vertical direction when the shoe 100 is placed on a horizontal plane and is recessed relative to the inner foot outer surface 22*f*.

According to this aspect, when the wearer of the shoe swings his/her leg by walking or running, negative pressure occurs at the air sucking out portion 30 by the outside airflow Af which flows along the inner foot outer surface 22*f*, so that air inside the internal space 20*a* can be sucked out to outside by utilizing this negative pressure. It is thereby possible to effectively ventilate inside the shoe 100. Further, the air sucking out portion 30 extends obliquely and is recessed, which increases a region along the flow of outside air, and which effectively utilizes the negative pressure.

The air sucking out portion 30 can include a portion disposed in a region which cannot be viewed from the front in a direction along the width-direction center line La of the shoe 100 on the inner foot outer surface 22*f*. In this embodiment, negative pressure is likely to occur in the region which cannot be viewed from the front of the inner foot outer surface 22*f*, so that efficient ventilation can be achieved.

In an embodiment where a length from the toe portion 26 to the heel portion 28 of the upper portion 20 is set as 100%, the air sucking out portion 30 can include a portion disposed in a longitudinal-direction region which is equal to or greater than 30% and equal to or less than 80% from the toe portion 26 on the inner foot outer surface 22*f*. In this embodiment, negative pressure is likely to occur in the longitudinal-direction region which is equal to or greater than 30% and equal to or less than 80% from the toe portion 26 of the inner foot outer surface 22*f*, so that efficient ventilation can be achieved.

The air sucking out portion 30 can include a portion disposed in a longitudinal-direction range 22*pe* specified by an innermost point 22*e* located at the innermost area of the inner foot outer surface 22*f* and an outermost point 22*p* located at the outermost the inner foot outer surface 22*f* in a top planar view on the anterior foot portion 22*a*. In this embodiment, negative pressure is likely to occur in the longitudinal-direction range 22*pe* of the anterior foot portion 22*a* of the inner foot outer surface 22*f* of the upper portion 20, so that efficient ventilation can be achieved.

A posterior edge 30*e* of the air sucking out portion 30 can be located below the line Lc connecting the innermost point 22*e* and the outermost point 22*p* of the upper portion 20. In this embodiment, negative pressure is likely to occur in a lower portion from the line Lc of the upper portion 20, so that efficient ventilation can be achieved.

The first angle θp of the air sucking out portion 30 can fall within a range from 20° to 70°, and the air sucking out portion 30 can have a slit shape in which the posterior edge 30*e* is slanted downward below the anterior edge 30*f*. In this embodiment, the extending direction of the air sucking out portion 30 can be substantially parallel to the direction of the outside airflow Af at a shoe angle at which the swing speed of the leg is at a peak speed when running. It is thereby possible to effectively utilize the negative pressure.

The air intake portion 40 for taking in outside air can be disposed on the outer surfaces 24*f* and 26*f* except the inner foot outer surface 22*f* of the outer surface of the upper portion 20, and the air intake portion 40 can extend in a direction intersecting the outside airflow Af when the leg of the wearer of the shoe swings, and can be recessed relative to the outer surfaces 24*f* and 26*f*. In this embodiment, the outside air is taken in through the air intake portion 40, so that it is possible to efficiently ventilate inside the shoe 100. Further, the air intake portion 40 extends in a cross direction, so that it is possible to efficiently take in outside air. Still further, the air intake portion 40 is recessed, so that it is possible to easily take in air while causing air to be taken in to collide with this portion.

The air intake portion 40 can include a portion disposed in a region which can be viewed from the front in a direction along the width-direction center line La of the shoe 100. In this embodiment, outside air hits the region which can be viewed from this direction when the leg of the wearer of the shoe swings, to efficiently take in outside air.

The air intake portion 40 can extend in the same direction as the extending direction of the air sucking out portion 30 in a state where the upper portion 20 is developed on a plane. In this embodiment, the shoe is physically beautiful and manufacturing is facilitated, since the air intake portion 40 is manufactured through a weave or knitting.

The air intake portion 40 can be disposed at the toe portion 26 of the upper portion 20 and can extend in a width direction. In this embodiment, fresh air can be effectively taken into the internal space 20*a*.

The air exhausting portion 44 which is capable of exhausting air in the internal space 20*a* can be disposed at the heel portion 28 of the upper portion 20. In this embodiment, it is also possible to exhaust air from a posterior portion.

The shoe tongue 70 on which the concave-convex portion 70*p* is disposed on the internal space 20*a* side can be provided, and the concave-convex portion 70*p* can be formed to enable ventilation in a thickness direction of the shoe tongue 70. In this embodiment, the concave-convex portion 70*p* forms a space between the top of the foot 8 and the shoe tongue 70, so that smooth ventilation through the concave-convex portion 70*p* can be achieved.

The air sucking out portion 30 can be formed through a jacquard weave or jacquard knitting. In this embodiment, the opening 30*h* and the meshed body 30*j* of the air sucking out portion 30 can be easily formed.

The example of the embodiment of the present invention has been described in detail above. The above-described embodiment merely describes a specific example for implementing the present invention. Content of the embodiment does not limit a technical scope of the present invention, and a number of design changes such as changing, adding and/or deleting components is possible within a range not deviating from idea of the invention recited in the claims. While the description has been provided in the above-described embodiment regarding content to which such design changes are possible with notation of "of the embodiment", "in the embodiment", and the like, design changes are also possible to content without such notation. Further, hatched portions of cross-sections in the drawings do not limit a material of the hatched portions.

Modified examples will be described below. In drawings and description of the modified examples, the same reference numerals will be assigned to components and members which are the same as or equivalent to those in the embodiment. Repetitive description with the embodiment will be omitted as appropriate, and description will be provided with emphasis on a configuration different from that in the embodiment.

First Modified Example

While the example has been described in the description of the embodiment where the concave-convex portion is disposed at the shoe tongue 70, the present invention is not limited to this configuration. The concave-convex portion can be disposed on the internal space 20*a* side of the toe portion 26.

Figure 16:
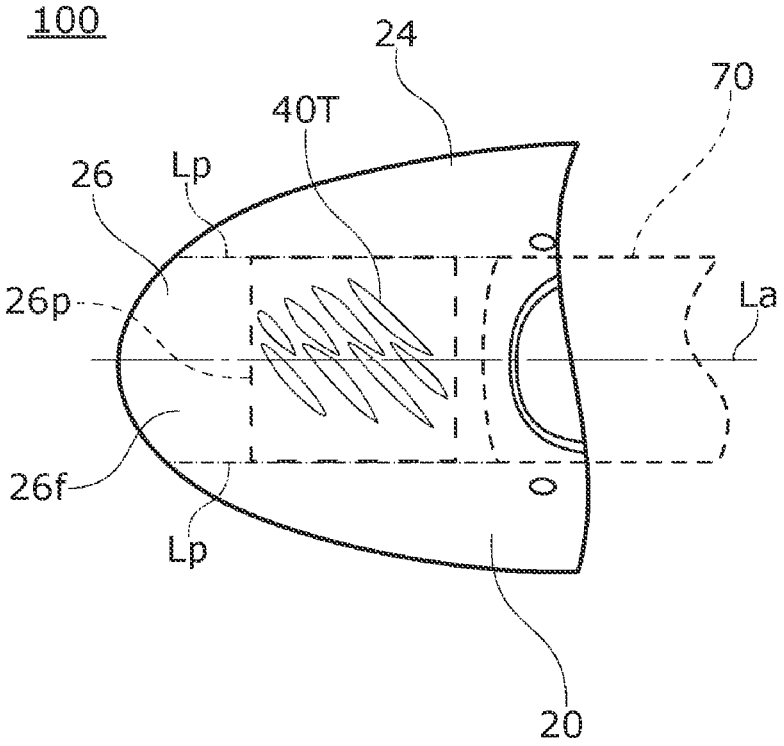
FIG. 16 is a plan view schematically illustrating a shoe according to a first modified example.

FIG. 16 is a plan view schematically illustrating the shoe 100 according to a first modified example. FIG. 16 illustrates a portion around the toe portion 26. A concave-convex portion 26*p* is disposed on the internal space 20*a* side of the toe portion 26 in the present modified example. In this embodiment, a concave-convex portion space is formed between the concave-convex portion 26*p* and the foot, and ventilation in a planar direction is encouraged at the concave-convex portion 26*p*, so that efficient ventilation through the air intake portion 40 can be achieved.

The concave-convex portion 26*p* can be disposed anywhere in a range in which desired ventilation performance can be obtained. In the present modified example, the concave-convex portion 26*p* is disposed in a region between two lines Lp which extend from right and left ends of the shoe tongue 70 to the toe in parallel to the center line La.

Other Modified Examples

While the example has been described in the description of the embodiment where the inner foot outer surface 22*f* on which the opening 30*h* is disposed and the meshed body 30*j* are integrally formed through a jacquard weave or jacquard knitting, the present invention is not limited to this configuration. For example, the inner foot outer surface on which the opening is disposed can be formed with a material such as a resin, and the meshed body can be pasted on the inner foot outer surface.

While the example has been described in the description of the embodiment where the first air intake portion 40T and the second air intake portion 40S are provided, the present invention is not limited to this configuration. For example, at least one of the first air intake portion 40T or the second air intake portion 40S does not have to be provided. Further, it is not essential to provide the air exhausting portion 44. Still further, it is not essential to provide the shoe tongue concave-convex portion 70*p* and the air intake hole 46.

While the example has been described in the description of the embodiment where the shoe tongue 70 includes the ventilation portion 70*c* at the central portion in the width direction, the present invention is not limited to this configuration. For example, the shoe tongue 70 can be formed with a material having ventilation characteristics in a thickness direction. Further, the ventilation portion 70*c* can be disposed at a portion other than the central portion. For example, the ventilation portion 70*c* can be disposed at a longitudinal-direction end portion or a width-direction end portion or can be disposed in an entire area of the shoe tongue 70.

While the example has been described in the description of the embodiment where a portion around the opening 30*h* of the inner foot outer surface 22*f* is flat, the present invention is not limited to this configuration. For example, a raised portion can be provided near a long side of an anterior portion of the opening 30*h* on the inner foot outer surface 22*f*. In this embodiment, the speed of the airflow Af is fast at the raised portion, so that a pressure of the opening 30*h* further decreases, and the inside air is efficiently sucked out.

Further, the inner foot outer surface 22*f* can be formed by a member different from the upper portion 20, and can have, for example, a configuration where the outer foot outer surface 24*f* rolls up and covers resin parts and the sole 10 which are separately formed. While a plurality of openings 30*h* is provided in FIG. 1, only a single opening 30*h* can be provided.

Further, an area ratio of the opening 30*h* with respect to an inner foot side of the upper portion is, for example, equal to or greater than 1%, preferably, equal to or greater than 5%, and, more preferably, equal to or greater than 10% for an area which can be viewed when the present shoe is viewed from the inner foot side with the objective of achieving efficient ventilation. Further, the area ratio can be equal to or greater than 1.5%, preferably, equal to or greater than 7.5%, and, more preferably, equal to or greater than 15% for an area of a region corresponding to the position L3 (position which is 80% from the toe portion 26) illustrated in FIG. 3 with the objective of achieving efficient ventilation. Meanwhile, in an embodiment in which the upper portion 20 is formed through a jacquard weave or jacquard knitting, the area ratio of the opening 30*h* with respect to the inner foot side of the upper portion can be, for example, equal to or less than 40%, preferably, equal to or less than 20%, and, more preferably, equal to or less than 12% with the objective of maintaining strength and fit. In a similar manner, the area ratio can be, for example, equal to or less than 50%, preferably, equal to or less than 25%, and, more preferably, equal to or less than 20% for the area corresponding to the position L3.

While the example has been described in the description of the embodiment where the outer foot outer surface 24*f* and a portion around the opening 40*h* of the toe outer surface 26*f* are flat, the present invention is not limited to this configuration. For example, a raised portion can be provided near a long side of a posterior portion of the opening 40*h* of the intake portion outer surface of the air intake portion 40. In this embodiment, the speed of the airflow Af is slow on a front side of the raised portion, so that the pressure of the opening 40*h* on the front side of the raised portion increases, and efficiently taking in of the outside air can be achieved.

Further, the outer foot outer surface 24*f* can be formed by a member different from the upper portion 20, and can have, for example, a configuration in which the inner foot outer surface 22*f* rolls up and covers resin parts and the sole 10 which are separately formed. While a plurality of openings 40*h* is provided in FIG. 2, only a single opening 40*h* can be provided.

Further, an area ratio of the opening 40*h* with respect to an outer foot side of the upper portion is, for example, equal to or greater than 1%, preferably, equal to or greater than 5%, and, more preferably, equal to or greater than 10% for an area which can be viewed when the present shoe is viewed from the outer foot side with the objective of achieving efficient ventilation. Meanwhile, in an embodiment in which the upper portion 20 is formed through a jacquard weave or jacquard knitting, the area ratio of the opening 40*h* with respect to the outer foot side of the upper portion can be, for example, equal to or less than 40%, preferably, equal to or less than 20%, and, more preferably, equal to or less than 12% with the objective of maintaining strength and fit.

The above-described respective modified examples provide operation and effects similar to those in the above-described embodiment.

Arbitrary combination of the above-described embodiment and the modified examples is also useful as an embodiment of the present invention. A new embodiment created by combination provides respective effects of the embodiment and the modified examples which are combined.

As can be understood, the present disclosure relates to shoes and can be utilized in shoes.

The invention claimed is:

1. A shoe comprising:

a sole; and an upper surrounding an internal space configured to accommodate a foot, the upper having a toe portion and a heel portion, the upper including a first outer surface of an inner foot portion, and a plurality of first openings from which air is capable of being expelled from the internal space to outside of the shoe when the shoe swings, the plurality of first openings being defined on the first outer surface of the inner foot portion, the plurality of first openings being provided on a medial side of the shoe and being slanted by a first angle with respect to a vertical direction when the shoe is placed on a horizontal plane, and the plurality of first openings being recessed relative to the first outer surface, the upper including a second outer surface on an outer foot portion and defining a plurality of second openings configured to enable outside air to ventilate the internal space, the second outer surface being at an opposite side of the upper relative to the first outer surface, the plurality of second openings including at least one of: lateral openings being provided on a lateral side of the shoe and being slanted by a second angle with respect to the vertical direction, and cross openings extending from the medial side to the lateral side of the shoe, the plurality of second openings being recessed relative to the second outer surface, and the medial side of the shoe having a different appearance than the lateral side of the shoe.

2. The shoe according to claim 1, wherein at least one of the plurality of first openings includes a portion disposed in a region of the upper which is not visible when viewed from a front in a direction along a width-direction center line of the shoe on the first outer surface.

3. The shoe according to claim 1, wherein when a length from the toe portion to the heel portion of the upper is defined as 100%, the plurality of first openings includes a portion disposed in a longitudinal-direction region which is equal to or greater than 30% and equal to or less than 80% from the toe portion along the first outer surface.

4. The shoe according to claim 1, wherein at least one of the plurality of first openings includes a portion disposed in a longitudinal-direction range specified by an innermost point of the inner foot outer surface and an outermost point of the first outer surface in a top planar view on an anterior foot portion.

5. The shoe according to claim 4, wherein a posterior edge of the plurality of first openings is located below a line connecting the innermost point and the outermost point of the upper.

6. The shoe according to claim 1, wherein the angle of each of the plurality of first openings falls within a range from 20° to 70°, and a posterior edge of each of the plurality of first openings has a slit shape which is slanted downward below an anterior edge of the first opening.

7. The shoe according to claim 1, wherein the plurality of second openings includes a portion disposed in a region which is visible when viewed from a front in a direction along a width-direction center line of the shoe.

8. The shoe according to claim 1, wherein the plurality of second openings is disposed at the toe portion of the upper and extends in a width direction.

9. The shoe according to claim 1, wherein an air exhausting portion which is capable of exhausting air in the internal space is disposed at the heel portion of the upper.

10. The shoe according to claim 1, further comprising a shoe tongue on which a concave-convex portion is disposed on a side adjacent to the internal space, and the concave-convex portion is configured to enable ventilation in a thickness direction of the shoe tongue.

11. The shoe according to claim 1, wherein one of the plurality of first openings and the plurality of second openings is formed by a jacquard weave or by jacquard knitting.

12. The shoe according to claim 2, wherein when a length from the toe portion to the heel portion of the upper is defined as 100%, each of the plurality of first openings includes a portion disposed in a longitudinal-direction region which is equal to or greater than 30% and equal to or less than 80% from the toe portion along the first outer surface.

13. The shoe according to claim 2, wherein the at least one of the plurality of first openings includes a portion disposed in a longitudinal-direction range specified by an innermost point of the first outer surface and an outermost point of the first outer surface in a top planar view on an anterior foot portion.

14. The shoe according to claim 3, wherein the at least one of the plurality of first openings includes a portion disposed in a longitudinal-direction range specified by an innermost point of the first outer surface and an outermost point of the first outer surface in a top planar view on an anterior foot portion.

15. The shoe according to claim 2, wherein the angle of the plurality of first openings falls within a range from 20° to 70°, and a posterior edge of the opening has a slit shape which is slanted downward below an anterior edge of the opening.

16. The shoe according to claim 3, wherein the angle of the plurality of first openings falls within a range from 20° to 70°, and a posterior edge of each of the plurality of first opening § has a slit shape which is slanted downward below an anterior edge of the plurality of first openings.

17. The shoe according to claim 4, wherein the angle of the plurality of first openings falls within a range from 20° to 70°, and a posterior edge of the opening has a slit shape which is slanted downward below an anterior edge of the opening.

18. The shoe according to claim 5, wherein the angle of the plurality of first openings falls within a range from 20° to 70°, and a posterior edge of each the plurality of openings has a slit shape which is slanted downward below an anterior edge of the opening.

19. The shoe according to claim 1, wherein an area ratio of the plurality of first openings with respect to the inner foot portion is less than or equal to 40%.

* * * * *